US005771424A

United States Patent [19]

Lindblad et al.

[11] Patent Number: 5,771,424

[45] Date of Patent: Jun. 23, 1998

[54] PRECONDITIONING OF PHOTORECEPTOR AND CLEANER BRUSH

[75] Inventors: Nero R. Lindblad, Ontario; Darryl L. Pozzanghera, Rochester; Charles M. Gardiner, Fairport; Larry G. Hogestyn, Ontario; Kenneth L. Timmons; Clive R. Daunton, both of Rochester, all of N.Y.

[73] Assignee: Xerox Corporation, Stamford, Conn.

[21] Appl. No.: 804,529

[22] Filed: Feb. 21, 1997

Related U.S. Application Data

[63] Continuation of Ser. No. 139,689, Oct. 22, 1993, abandoned, and Ser. No. 446,188, May 19, 1995, abandoned.

[51] Int. Cl.[6] ..... G03G 15/00

[52] U.S. Cl. ..... 399/71; 399/354

[58] Field of Search ..... 15/256.5, 256.51, 15/256.52; 399/353, 354, 355, 349, 71

[56] References Cited

U.S. PATENT DOCUMENTS

| | | | |
|---|---|---|---|
| 4,134,673 | 1/1979 | Fisher . | |
| 4,711,555 | 12/1987 | Toshimitsu et al. | 399/343 |
| 4,945,388 | 7/1990 | Tange et al. | 399/347 |
| 4,956,677 | 9/1990 | Akiyama | 399/129 |
| 4,962,408 | 10/1990 | Masuda et al. | 335/245 |
| 5,107,285 | 4/1992 | Hamada et al. | 347/130 |
| 5,128,725 | 7/1992 | Frankel et al. | 399/347 |
| 5,151,744 | 9/1992 | Lundy et al. | 399/71 |
| 5,153,658 | 10/1992 | Lundy et al. | 399/353 |
| 5,177,553 | 1/1993 | Ohike et al. | 399/353 |
| 5,233,398 | 8/1993 | NImura et al. | 399/354 |
| 5,315,358 | 5/1994 | Parks et al. | 399/355 |

*Primary Examiner*—Robert Beatty

[57] ABSTRACT

A preconditioning process and dual electrostatic brush cleaning apparatus for reducing adhesion of toner particles on the photoreceptor surface such that cleaning of the photoreceptor is enhanced. Preconditioning of the brush and/or the photoreceptor in the cleaning apparatus allows for cleaning of dual polarity toners, CAD toners and DAD toners. The preconditioning of the brush does not need replenishing once the print operation begins due to the electrostatics that maintain a constant predetermined level of toner in the brush.

19 Claims, 4 Drawing Sheets

PRECONDITIONING OF PHOTORECEPTOR AND CLEANER BRUSH

This application is a continuation of application Ser. Nos. 08/139,689 & 08/446,188, filed 10/22/1993 & 5/19/1995, respectively, now abandoned.

BACKGROUND OF THE INVENTION

This invention relates generally to an electrostatographic printer and copier, and more particularly, concerns a process for preconditioning a cleaning apparatus for removal of residual particles and agglomerates from the imaging surface (e.g. photoreceptor and photoconductor).

Electrostatographic printers and copiers can create often difficult cleaning problems on the imaging surface and, when toners of more then one polarity are involved these difficult cleaning problems are compounded making it difficult for conventional cleaners to handle.

In a colored image forming apparatus, an electrostatic latent image which is to be developed by a predetermined color is formed on a photoconductor by an optical system of a copying machine or printer. Then, the electrostatic latent image is developed by a developing unit which accommodates a predetermined colored toner to be used for development. This toner image may be subsequently transferred to a support surface such as copy paper to which it may be permanently affixed by heating or by the application of pressure. After each transfer process, the toner remaining on the photoconductor is cleaned by a cleaning device.

However, when colored toners other than black toner are cleaned from the photoreceptor, there is a tendency for more residual toner to remain on the photoconductor. Thus, the photoreceptor is not able to be efficiently cleaned by the same process that is used to clean black toner alone from the photoreceptor. Possible reasons for the additional filming on the photoconductor caused by the color toners are the dye, pigment or additive used in the color toners. For example, zinc stearate (ZnSt) and Aerosil are essential additives to the color toners to enhance toner flow and stabilize developer conductivity. During the printing process the ZnSt is preferentially developed in the background regions of the photoreceptor, not transferred to the print paper, and subsequently smeared on the photoreceptor by the cleaner brushes. As the ZnSt film thickens with time, Aerosil particles become embedded in the film, causing a secondary print quality defect referred to as deletions, Charge Area Development (CAD) loss, or lateral charge conductivity.

Certain print mode and/or material mass per unit time throughput (i.e., where throughput is greater than 5% color area coverage) conditions in a single pass highlight color printer enable or promote photoreceptor filming by the Discharge Area Development (DAD) toner additive zinc stearate (ZnSt). Such film is the origin of the tri-level Image Push defect. Image Push defect is the movement of the color toner during the black development cycle due to the loss of the coefficient of friction on the P/R surface by the formation of the slippery ZnSt, or the sliding of the color image on the photoreceptor as it passes by the black developer housing due to the loss of coefficient of friction on the photoreceptors by the slippery ZnSt.

Various ideas as to how to improve cleaning efficiency have been disclosed. One publication suggested mixing toner with a small amount of low adhesive polymeric additive in smaller average particle size than that of the toner of each developer. Another publication discloses each developer being mixed with an abrasive for removing matter adhered to the photoconductor when the cleaning process is conducted. However, in the colored image forming apparatus, it is a laborious task to mix the proper amount of suitable polymeric additive or abrasive with each developer and it can become expensive. Moreover, it is not preferable for use in forming a colored image which requires a delicate tone since it badly affects the clearness of color and permeability when the additive or abrasive are mixed with a colored toner other than black toner. Yet another publication discloses an idea for removing a matter adhered to the photoconductor with a resin by providing a grinding device aside from a cleaning device. Additionally, mechanical cleaners use insulative brushes and are limited in their ability to clean 100% of the residual toner on the photoreceptor at process speeds 8 ips or greater. These cleaners cannot clean untransferred images in a single pass. Also they are limited in their ability to clean dual polarity toners. Furthermore, mechanical brush cleaners have a high brush rpm (greater than 1000 rpm). This high brush rpm adversely effects photoreceptor life, brush life and increases toner emissions.

The following disclosures may be relevant to various aspects of the present invention and may be briefly summarized as follows:

U.S. Pat. No. 5,153,658 to Lundy et al. discloses a process for controlling the amount of DAD toner additive (i.e. Zinc Stearate) film buildup on a photoreceptor by continuously replenishing the toner in the fibers of the insulative cleaner brushes. The interdocument area is coated with toner to replenish the brush fibers.

U.S. Pat. No. 5,151,744 to Lundy et al. discloses a process for controlling the amount of DAD toner additive (i.e. Zinc Stearate) film buildup on a photoreceptor by continuously replenishing the toner in the fibers of the insulative cleaner brushes. The imaging area is coated with toner to replenish the brush fibers.

U.S. Pat. No. 4,945,388 to Tange et al. describes a method and apparatus for cleaning a color image from a photoreceptor wherein a black toner only image is transferred onto the photoreceptor periodically when the color developing units are actuated, without any transfer process, to remove residual black toner. A black toner only image is fixed to the photoreceptor during machine startup and after a certain number of copies.

SUMMARY OF INVENTION

Briefly stated, and in accordance with one aspect of the present invention, there is provided a method for loading particles on a brush adapted to contact an imaging surface used in a printing machine of the type having successive images developed thereon, comprising the steps of: initializing a clean brush; forming an image developed with the particles on the imaging surface; removing the particles from the imaging surface with the brush such that the particles adhere to the brush; stopping initializing of the brush; and actuating the printing machine to start the printing process.

Pursuant to another aspect of the present invention, there is provided an apparatus for loading particles on a brush adapted to contact an imaging surface used in a printing machine of the type having successive images developed thereon, comprising: means for initializing a clean brush; means for forming an image developed with particles recorded on the imaging surface; means for removing the particles from the imaging surface with the brush such that the particles adhere to the brush; means for stopping initializing of the brush; and means for actuating the printing machine to start the printing process.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 6:
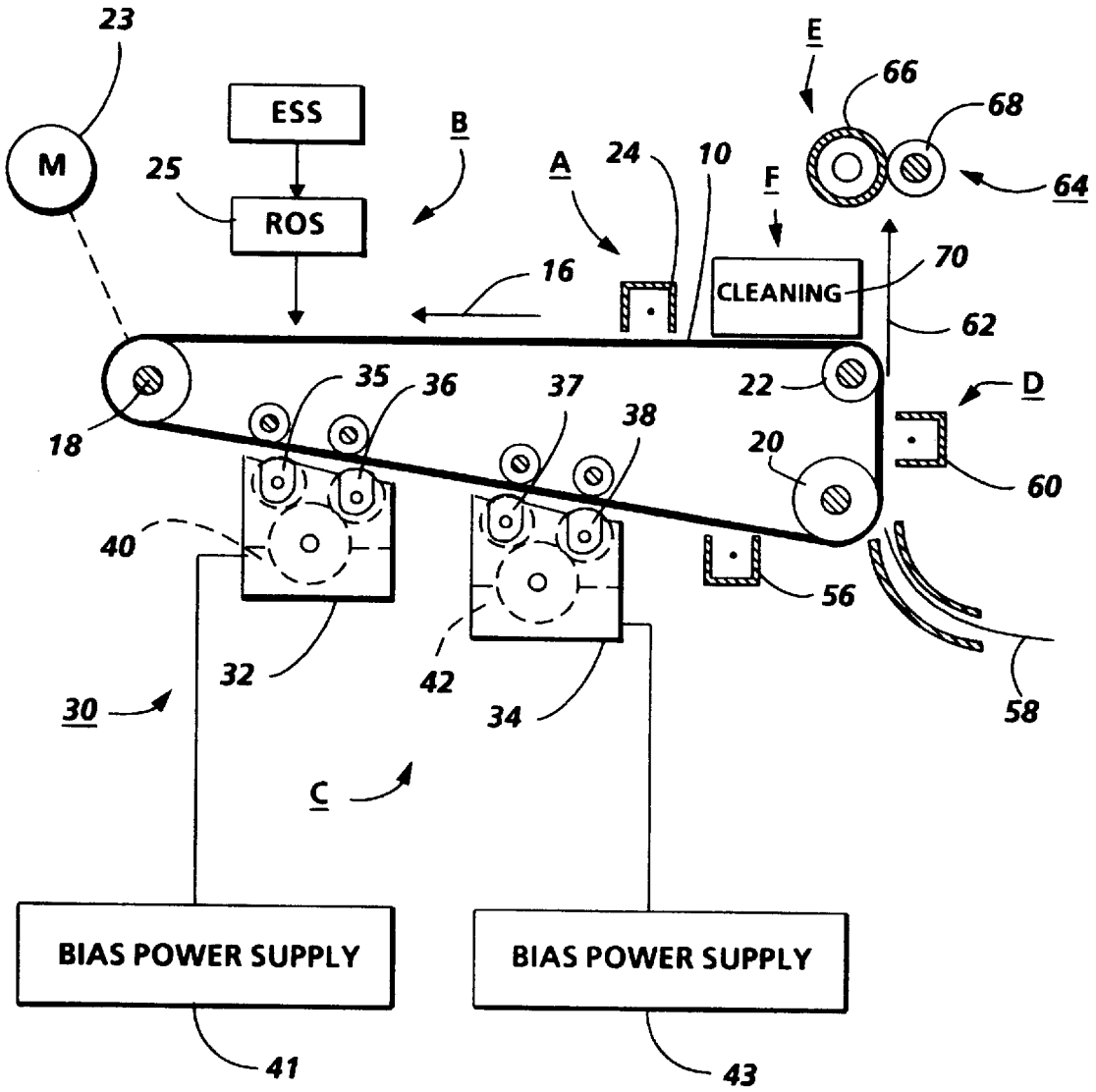
FIG. 6 is a schematic illustration of a printing apparatus incorporating the inventive features of the invention.

For a general understanding of an electrostatographic printing machine in which the present invention may be incorporated, reference is made to FIG.6 which depicts schematically the various components thereof. Hereinafter, like reference numerals will be employed throughout to designate identical elements. Although the cleaning apparatus of the present invention is particularly well adapted for use in an electrostatographic printing machine, it should become evident from the following discussion, that it is equally well suited for use in a wide variety of devices and is not necessarily limited to the particular embodiments shown herein.

A reproduction machine in which the present invention finds advantageous use utilizes a charge retentive member in the form of a photoconductive belt 10 consisting of a photoconductive surface and an electrically conductive, light transmissive substrate and mounted for movement past a charging station A, an exposure station B, developer stations C, transfer station D, and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 6, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both chargedarea images and discharged-area images as well as charged edges corresponding to portions of the photoreceptor outside the image areas. [The high voltage latent image is developed with positive (+) charged black toner and is called Charge Area Development (CAD). The low voltage latent image is developed with negative (−) charge color toner and Discharge Area Development (DAD)].

The photoreceptor, which is initially charged to a voltage, undergoes dark decay to a lower voltage level. When exposed at the exposure station B it is discharged to near zero or ground potential in the highlight (i.e. color other than black) color parts of the image. The photoreceptor is also partially discharged in the background (white) image areas. After passing through the exposure station, the photoreceptor contains charged areas and discharged areas which correspond to two images and to charged edges outside of the image areas.

At development station C, a development system, indicated generally by the reference numeral 30, advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray with sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying.

Residual toner and debris remaining on photoreceptor belt 10 after each copy is made, may be removed at cleaning station F with a brush cleaning system 70.

Figure 1:
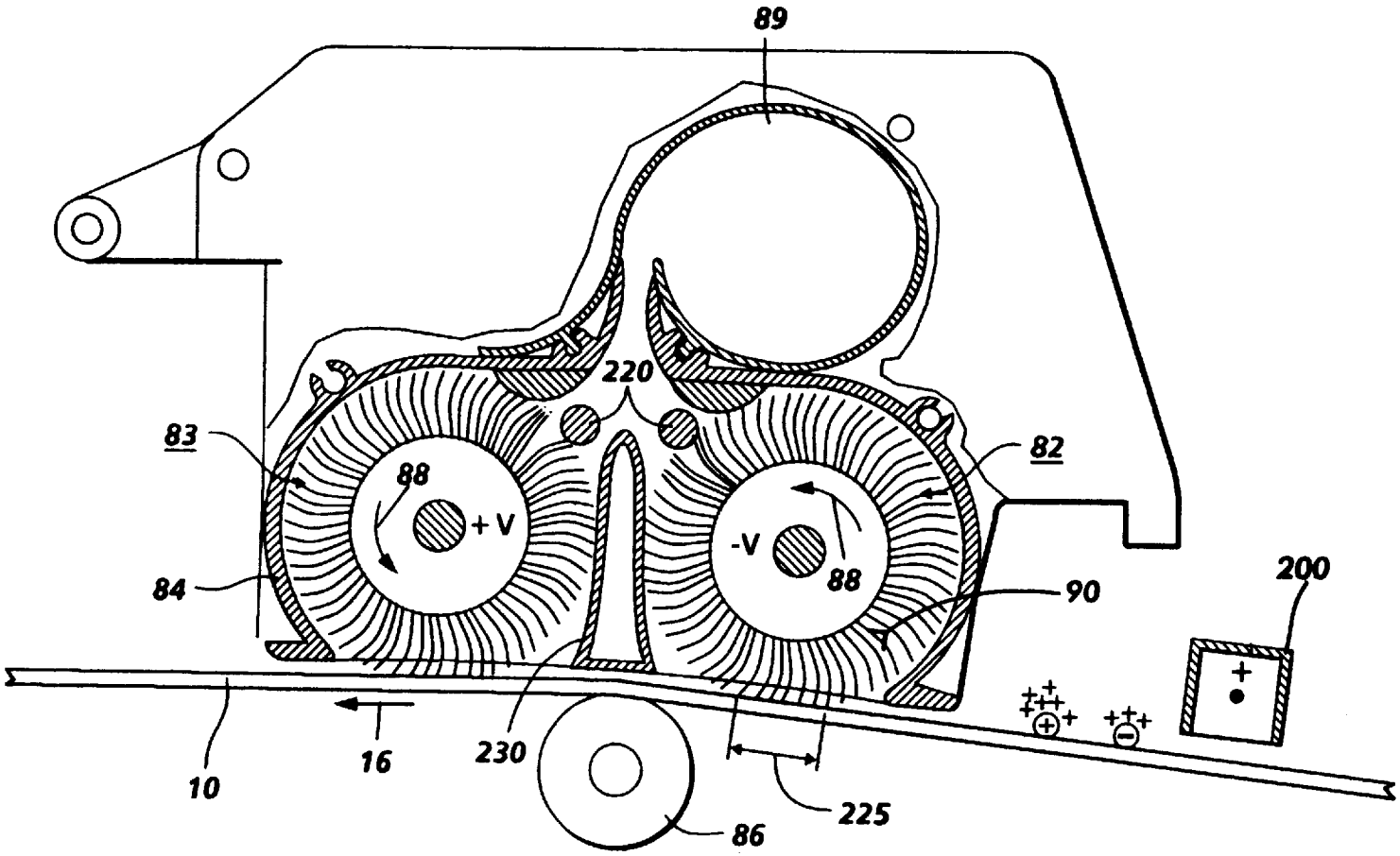
FIG. 1 is a schematic of the dual electrostatic brush cleaner.

Referring now to FIG. 1 which shows a dual electrostatic brush (DESB) cleaning brush system. This cleaner has dual electrostatic brushes 82 located in a cleaner housing 84. The brush fibers 90 rotate against the photoreceptor 10 surface supported by a cleaning roll 86. The dual electrostatic brushes 82 rotate in the same direction 88 at low rpm and are biased at opposite polarity to clean all types of toner including positive and negative toner (dual polarity toners), CAD toner, and single polarity DAD type toner at process speeds up to 22 ips or higher. This process speed corresponds to 135 cpm or greater. It is this preconditioning that allows cleaning of both DAD and CAD toners.

The bias on the electrostatic brush, and the air and flicker bar 220 detoning system, maintain the black toner in the first brush 82 at the correct level to prohibit the build up of additive films (ZnSt and Aerosil) on the photoreceptor 10. Thus, controlling the build up of the additive films on the photoreceptor 10. The electrostatics of the brushes 82, 83 attract and hold one of the toners, either positive (+) or negative (−) depending on the bias of the brush. In the embodiment of the present invention shown in FIG. 1, the first brush, in the direction of movement 16 of the photoreceptor 10, is negatively charged to attract positive toner particles. The second brush 83 is positively charged to attract negative particles remaining on the photoreceptor that were not removed by the preconditioned toner laden brush 82. The preclean corotron 200, located prior to the first brush 82 (in the direction of movement of the photoreceptor indicated by arrow 16), provides a positive charge to the particles remaining on the imaging surface.

The brushes 82 are contained in a single housing 84 with a continuous flow of air, provided by an air vacuum 89, into and out of the housing 84 to eliminate toner emissions and remove debris from the brush fibers 90. The housing design and the flow of air through the cleaner is unique. A contoured baffle 230 separating the two brushes 82,83 creates a pseudo two housing cleaner allowing air to flow independently in each side of the cleaner. The single housing also reduces the size of the cleaner and the cleaner UMC (unit manufacturing cost).

This DESB (i.e. dual electrostatic brush) cleaner cleans 100% of the residual toner on the photoreceptor 10 at the outset if the brushes are preconditioned with black toner. The residual image left on the photoreceptor after the cleaner is less than 30 particles per $mm^2$. This is a 50% improvement over the present conventional ESB (i.e. electrostatic brush) cleaners.

Detoning an electrostatic brush 82, 83 is difficult. The present invention has two detoning steps to reduce the detoning difficulty of ==electrostatic brushes. The initial detoning takes place just after the fibers #2 leave the cleaning nip 225 and the final detoning takes place at the flicker bars 220. (The interference of the brush with the imaging surface leaves a footprint. This footprint is the cleaning nip.) However, the predetermined amount of toner, due to preconditioning, in the first brush remains after detoning. The set points (i.e. air flow, cfm and bias (voltage difference)) of the cleaner and vacuum, control toner in the brush. The operating space, or cleaner latitude is defined in terms of preclean current ($I_{pc}$) and the brush bias, $V_B$. The cleaner brush biases and the preclean current are set near the center of the window for these values. These latitudes are constructed for fixed air flow (cfm) and brush rpm. The results from machine testing have shown that the amount of black toner in the brush remains constant in the operating space or true cleaning latitude for the given air flow and brush rpm.

With continued reference to FIG. 1, the DESB cleaner of the present invention has a very large operating window for cleaning executive black toner, and tri-level images, i.e., black plus a color (e.g. red, green or blue). This cleaner is extremely robust. However, there are initial requirements for the brushes 82, 83, and or, the photoreceptor to clean 100% of the residual images at the outset as stated above. One example where this is important is in a newly installed machine with a new photoreceptor 10 and clean BASF or SA-7 brushes. (It is noted that a "clean" brush is not only a new brush but also one that has been vacuumed clean of toner.) The residual transferred and untransferred images of black toner (such as control patches) will not clean until the first brush 82 becomes loaded with enough black toner, and or, the photoreceptor is pretreated with ZnSt.

The present invention is that of the requirements for a cleaner brush to remove residual particles and agglomerations from the imaging surface. The two brush materials experimentally tested as part of the present invention are BASF and SA-7. Preconditioning of these brush materials and the photoreceptor 10 and the methods of preconditioning are discussed below.

One brush material is the BASF brush material. It was determined through experimentation that the first brush 82 (B1) of the dual conductive brush cleaning system must be preconditioned with approximately 12 grams of black toner, or the photoreceptor must be preconditioned with Zinc Stearate (ZnSt) to initiate cleaning of all black residual images upon initiation of the printing process. For the second brush material of SA-7, it was determined experimentally that B1 must be preconditioned with approximately six grams of black toner to clean black and green toner particles. (See Table 5 which provides a chart that shows the number of prints necessary during preconditioning to attain the predetermined amount of six grams). The preconditioning of the photoreceptor with ZnSt was not tested on the SA-7 brush but it is believed that the SA-7brush results would have been comparable to that of the BASF brush material because it is the ZnSt on the photoreceptor, not on the brush, that reduces adhesion of the black toner particles on the photoreceptor 10.

The experimental results presented here are for black and green toner, but these results could also apply to black toner with other colors such as red and/or blue toner. It is noted that with the preclean 200 and brush bias polarity shown in FIG. 1, the first brush 82 (B1) is set up to clean the black toner, (i.e. positive toner), and the second brush 83 (B2) is set to clean the color toner (i.e. negative toner).

Tables 1 and 2 summarize the preconditioning requirements for BASF and SA-7 brush materials. Tables 3 and 4 summarize the tests carried out to develop the preconditioning requirements. (All tables are located at the end of the specification.)

The following are the preconditioning requirements for brushes made using BASF material. The black toner requirement of B1 (the first brush in the direction of movement of the photoreceptor) shown in Table 1 for BASF material, approximately 12.6 grams of black toner are required in B1 to clean executive black toner. If the first brush 82 is clean, (e.g. vacuumed clean or new) black toner can not be cleaned off a new or used photoreceptor thus, this indicates that the level of black toner in the first brush must be approximately 12 grams to obtain good cleaning of executive black toner. This is an experimental result and may be associated with loading the fibers with toner to create abrasion of the image, or create a disturbing action to the image. This same amount of toner in B1 is also recommended for cleaning color toner as well as black toner.

There are several methods available to add toner to the brush. One method is the use of diagnostic routines to add toner to a brush. Another method is that the brush (B1) can be doped initially by dusting toner on the brush. Still another method would be to let the machine run the appropriate number of black prints initially after the machine has been installed, or when the brushes are cleaned or replaced with new brushes, prior to the start-up of the initial print run. Experimentation found that approximately 2000 prints of 25% area coverage executive black was needed to bring the level of black toner in B1 to 12.6 grams. Furthermore, testing has shown that the level of black toner in B1 achieved by preconditioning is maintained even in a print run when the area coverage is a black document. This is due to the electrical bias on the brush that holds the toner on the fibers. There is a threshold 'steady state' (i.e. amount of toner that the biased brush can hold before it releases the toner) that the brush holds before the air starts to detone the brush. A poor detoning system occurs when too much toner is left in the brush because this excess toner can fall out and redeposit on the imaging surface. In the present invention, air flow is sufficient to detone the excess toner out of the brush and maintain the necessary amount, i.e., approximately 12 grams. This occurs in a black or color running mode. That is, black toner is maintained in the brush in an executive black print run, a color only print run, and in a black and color print run.

Another case where a black cleaning failure could occur is when the customer runs executive color, and then switches to an executive black mode or black plus a color. In the executive color mode ZnSt is deposited on the photoreceptor 10, and switching to black, or black plus a color would not be a problem. Executive black toner can by cleaned from the photoreceptor 10 by simply coating the photoreceptor 10 with ZnSt (see Table 2), in which case 12.6 grams of the black toner is not required in B1. The ZnSt can be applied to the photoreceptor by doping the BASF brush fibers of B1 with 0.2 grams of ZnSt, and then starting the black executive print run. Experimentation showed good cleaning occurred under these test conditions. Tests 8, 9 and 10 in Table 3 show that it is the ZnSt on the photoreceptor that is important, not the ZnSt in the brush. This result confirms that ZnSt reduces the adhesion of the black toner to the photoreceptor. (The effects of ZnSt on toner adhesion has been known for many years.)

The requirement for cleanability in other machines such as the Xerox 5090 and Xerox 5100 is 80 particles per $mm^2$ left on the photoreceptor after the cleaner. In the present invention the cleanability can be reduced to less than 30 particles per $mm^2$. In a highlight color printer, residual toner after the cleaner will contaminate the developer housings and change the color quality in the developer. Thus, the cleaner must clean upon initiation, hence the need for preconditioning prior to printer start-up. It was shown experimentally that with 'clean' brushes, approximately 1000 prints of black toner must be run to load the first brush with black toner. This means that if the cleaner does not clean at initiation of the printing process a cleaning failure would occur for at least 1000 prints or even more. This is unacceptable in a color copier because the developer housing would become contaminated with wrong color toner. In addition, this type of failure is unacceptable to customers of the machine. Furthermore, since black toner in the brush controls the level of ZnSt film on the photoreceptor, failure to precondition, as in the present invention, could lead to excessive ZnSt filming.

The level of ZnSt on the photoreceptor is very important. It is known from other machine studies (i.e. Xerox 4850) that if the level of ZnSt becomes too thick (approximately greater than 50 A°) image push can occur. Thus, the application of ZnSt must be used in a careful manner.

Other methods that can be employed to coat the photoreceptor with ZnSt include: i) dusting the ZnSt on the photoreceptor with a pouch and then lightly rubbing to form a film; or ii) probably the best method is to have the printer run heavy area coverage color prints, or a dark dusting of color to put a uniform coating on the photoreceptor.

The following are the preconditioning requirements for brushes made using SA-7 material. The black toner requirement of B1 (the first brush 82 in the direction of movement of the photoreceptor 10) shown in Table 1 for SA-7 material, is about one gram of black toner to clean executive black toner. Thus, a simple, short cycle up procedure will store enough black toner in B1 to start cleaning at the outset. However, with only one gram of toner in B1, it is unlikely the green toner will be cleaned. As shown in Table 1, about six grams of black toner are required in B1 to clean green toner. The brushes should be primed with black toner at the time of installation of the printer, or after a preventive maintenance call if the housing and brushes are cleaned or replaced with new brushes. The methods discussed above to load the BASF brushes with toner can also be used to load the SA-7 brushes with toner. As with the BASF material brushes, testing has shown that the level of black toner in B1 after preconditioning is maintained regardless of the variety in print jobs performed. Thus, even if a color print job is run the level of black toner in B1 does not drop to such a level that it can no longer clean. For example, to clean both black and green effectively at least six grams of black must be in B1. If an executive color job is run, experimental testing has shown that the level of black toner in B1 does not drop to a level where green toner is not cleaned.

A chart (see Table 5) was developed through testing to determine what amount of toner would be deposited for removal from the photoreceptor 10 and adherence by the first brush 82 in the direction of movement of the photoreceptor 10. It was discovered through testing that regardless of the brush material, the first brush must be primed with black toner to start cleaning upon initiation of the printing cycle. However, testing also showed that once the first brush has enough black toner to clean, this desired level of toner does not decrease.

Figure 2:
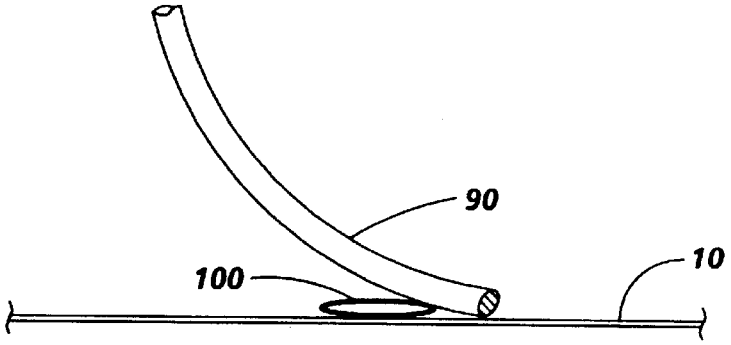
FIG. 2 is a schematic of a brush fiber contacting a toner additive particle.
Figure 3:
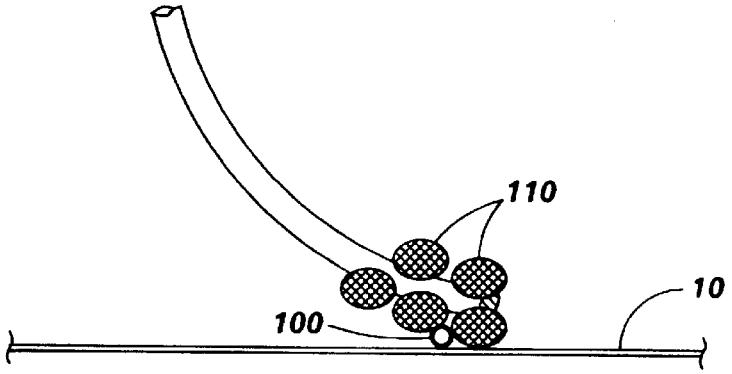
FIG. 3 is a schematic of black toner attached to the fiber tips of the brush.
Figure 4:
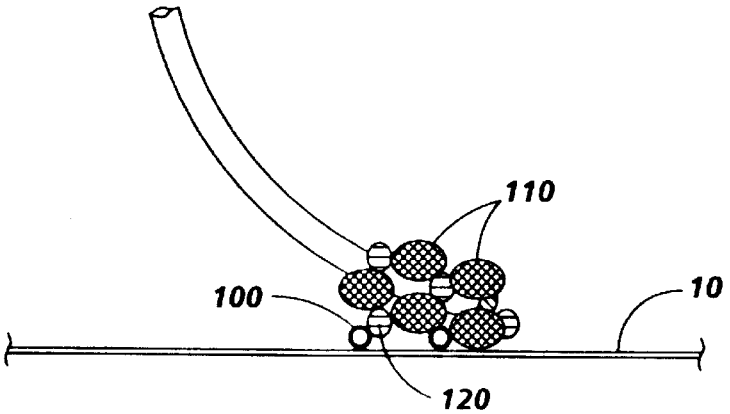
FIG. 4 is a schematic of black toner and aerosil attached to the fiber tips of the brush as the brush fiber contacts a toner additive particle.

Referring now to FIGS. 2, 3, and 4. FIG. 2 shows what occurs in the typical mode of cleaning the photoreceptor. The brush fiber 90 as it rotates against the photoreceptor 10 contacting the surface has a tendency to smear the additive particles 100 (e.g. ZnSt). The smearing results from the force of the brush fibers 90 rotational momentum as they land on the additive particle. The present invention of loading the brush 82 fibers with positively charged toner to avoid additive smearing and to control additive film buildup can perform in one of the following ways shown in FIGS. 3 or 4. In FIG. 3, it is shown how the black toner (positive) 1 10 attaches to the brush fiber 90, to provide a buffer between the individual fibers 90 and the photoreceptor 10 surface thereby, preventing the brush fibers from smearing the additive particles 100 as the fibers 90 rotate. FIG. 4 shows the attachment of black toner (positive) 1 10 and Aerosil particles 120 to the brush fibers 90. The Aerosil particles 120 abrade the additive particles 100 (e.g. ZnSt) film from the photoreceptor 10 surface.

Figure 5:
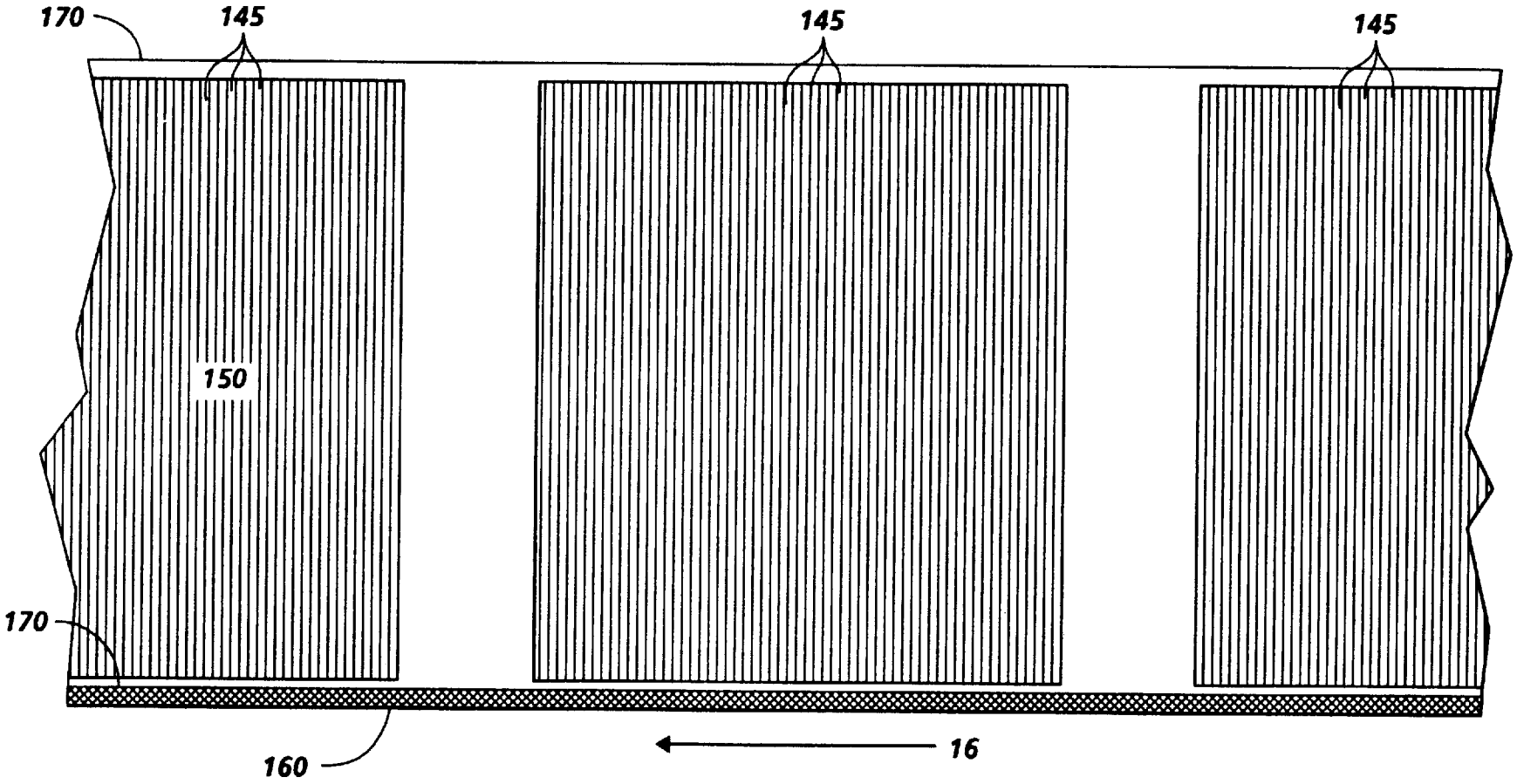
FIG. 5 shows a schematic of the toner lined image area on a photoreceptor.

Referring now to FIG. 5, a mass of black toner particles are placed in the image area 150 in a line pattern 145. In this invention, prior to start-up of the printing operation, a predetermined mass of black toner particles (See Table 5) are placed in the imaging area 150 of the photoreceptor 10. During preconditioning the first conductive brush, in the direction of motion of the photoreceptor 10, is used to remove all of the predetermined amount of black particles (see Table 5) from the imaging area 150. (The process direction is indicated by the arrow 16, photoreceptor edges by 170, and the ground strip by 160.) The preconditioning continues until the predetermined mass of black toner is held in the brush fibers of the first conductive brush 82. Once the first conductive brush has been preconditioned, the brush does not require further toner replenishing throughout the printing run. A full preconditioning of the first conductive brush (B1) is required for a newly built machine or when a new cleaner brush replaces the preconditioned brush installed in the field or the preconditioned brush is vacuumed cleaned. As previously stated, a predetermined amount of toner (see Table 5) determines the amount of toner to be placed on the photoreceptor imaging area 150 for preconditioning of the brush 82.

In recapitulation, the present invention is a preconditioning method for a dual electrostatic brush cleaning apparatus to clean the photoreceptor in a single pass color printer upon initiation of the printer. The first brush, in the direction of movement of the photoreceptor, is initialized or preconditioned by being loaded with a predetermined amount of black toner particles removed from the imaging surface of the photoreceptor. The preconditioned brush is then used to clean the imaging surface. This predetermined amount of black toner is maintained within the brush fibers, without the need for replenishing, throughout the life of the printer's cleaning apparatus unless, the brush must be replaced or cleaned. At that time, the new or cleaned brush is preconditioned in the same manner. Another preconditioning method involves coating the surface of the photoreceptor with ZnSt to reduce adhesion of the black toner particles to the photoreceptor. The advantages obtained with the electrostatic brush cleaner of the present invention include better overall cleaning ability, containment of toner in the cleaner, lower brush rpm, and improved reliability.

It is, therefore, apparent that there has been provided in accordance with the present invention, a cleaning apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

TABLE 1

| | BRUSH | | | | | |
|---|---|---|---|---|---|---|
| BRUSH | BRUSH REQUIREMENTS | | | METHOD OF TREATMENT | | |
| MATERIAL | TO CLEAN BLACK ONLY | TO CLEAN GREEN ONLY | TO CLEAN GREEN AND BLACK | TO CLEAN BLACK ONLY | TO CLEAN GREEN ONLY | TO CLEAN GREEN AND BLACK |
| BASF | 12.6 GRAMS OF BLACK TONER IN B1 | 12.6 GRAMS OF BLACK TONER IN B1 IS RECOMMENDED TO CLEAN GREEN AT OUTSET (LOWEST LEVEL OF BLACK TONER IN B1 WAS NOT DETERMINED TO CLEAN GREEN ONLY) | 12.6 GRAMS OF BLACK IN B1 | •1000 PRINTS OF ~25% AREA COVERAGE OF BLACK ONLY, OR EQUIVALENT | •1000 PRINTS OF ~25% AREA COVERAGE OF BLACK ONLY, OR EQUIVALENT (NOTE THIS IS RECOMMENDED BECAUSE LOWEST LEVEL OF BLACK IN B1 TO CLEAN GREEN WAS NOT DETERMINED) | •1000 PRINTS OF ~25% AREA COVERAGE OF BLACK ONLY, OR EQUIVALENT |
| SA-7 | 1 GRAM 6F BLACK TONER IN B1 | 6.6 GRAMS OF BLACK TONER IN B1 | 6.6 GRAMS OF BLACK TONER IN B1 | ~30 PRINTS OF BLACK, OR BLACK AND GREEN | •800 PRINTS OF ~25% AREA COVERAGE OF BLACK ONLY, OR EQUIVALENT •DOPE B1 WITH BLACK TONER | •800 PRINTS OF ~25% AREA COVERAGE OF BLACK ONLY, OR EQUIVALENT •DOPE B1 WITH BLACK TONER |

PRECONDITIONING REQUIRED TO START CLEANING WITH FULL OPERATING LATITUDE RANGE

TABLE 2

| BRUSH | PHOTORECEPTOR REQUIREMENTS | | | METHOD OF TREATMENT | | |
|---|---|---|---|---|---|---|
| MAT-ERIAL | TO CLEAN BLACK ONLY | TO CLEAN GREEN ONLY | TO CLEAN GREEN AND BLACK | TO CLEAN BLACK ONLY | TO CLEAN GREEN ONLY | TO CLEAN GREEN AND BLACK |
| BASF | ZNST ON PHOTORECEP-TOR | NONE | NONE | •APPLY ZNST TO PR VIA BRUSHES, I.E., DOPE BRUSHES WITH ZNST •APPLY ZNST TO PR INITIALLY; DUST PR AND RUB IN | NONE | NONE |
| SA-7 | NONE (SEE BRUSH REQUIRE-MENT OF TABLE 4) | NONE (SEE BRUSH REQUIREMENT OF TABLE 4) | NONE (SEE BRUSH REQUIREMENT OF TABLE 4) | NONE (SEE BRUSH REQUIREMENT OF TABLE 4) | NONE (SEE BRUSH REQUIREMENT OF TABLE 4) | NONE (SEE BRUSH REQUIREMENT OF TABLE 4) |

PRECONDITIONING REQUIRED TO START CLEANING WITH FULL OPERATING LATITUDE RANGE

TABLE 3

PRECONDITION TESTS FOR BASF BRUSHES

| TEST | TONER | BRUSH | PROCEDURE | RESULTS |
|---|---|---|---|---|
| 1 | BLACK ONLY | BASF | 1. NEW BELT<br>2. BRUSHES CLEAN<br>3. PRECONDITIONING BELT: NO<br>4. MEASURE BLACK LATITUDE | BLACK FAILS |
| 2 | BLACK ONLY | BASF | 1. USED BELT WITH BLACK ONLY TONER<br>2. BRUSHES CLEAN<br>3. PRECONDITIONING BELT: 500 BLACK PRINTS<br>4. MEASURE BLACK LATITUDE | BLACK FAILS<br>B1 = 6.0 g<br>B2 = 0.7 g |
| 3 | BLACK ONLY | BASF | 1. USED BELT WITH BLACK ONLY TONER<br>2. BRUSHES CLEAN<br>3. PRECONDITIONING BELT: 1000 BLACK PRINTS<br>4. MEASURE BLACK LATITUDE | BLACK FAILS<br>B1 = 8.7 g<br>B2 = 0.5 g |
| 4 | BLACK ONLY | BASF | 1. USED BELT WITH BLACK ONLY TONER<br>2. BRUSHES CLEAN<br>3. PRECONDITIONING BELT: 1000 BLACK PRINTS<br>4. MEASURE BLACK LATITUDE | BLACK CLEANS<br>B1 = 12.6 g, B2 = 0.6 g<br>FOR THE BASF BRUSH TO CLEAN BLACK TONER 12.6 GRAMS OF BLACK TONER ARE REQUIRED IN THE FIRST BRUSH(B1) |
| 5 | BLACK AND GREEN | BASF | 1. USED BELT WITH BLACK AND GREEN TONER<br>2. BRUSHES DIRTY FROM TEST 4(B1 = 15.2 g, B2 = 13 g)<br>3. PRECONDITIONING BELT 20 PRINTS BLACK AND GREEN<br>4. MEASURE BLACK AND GREEN LATITUDE | BLACK FAILS AND GREEN CLEANS |
| 6 | BLACK AND GREEN | BASF | 1. USED BELT WITH BLACK AND GREEN TONER<br>2. BRUSHES DIRTY FROM TEST 5 (B1 = 14.6 g, B2 = 0.5 g)<br>3. PRECONDITIONING BELT 100 PRINTS GREEN ONLY<br>4. MEASURE BLACK AND GREEN LATITUDE | BLACK FAILS AND GREEN CLEANS |
| 7 | BLACK AND GREEN | BASF | 1. USED BELT WITH BLACK AND GREEN TONER<br>2. BRUSHES DIRTY FROM TEST 6 (B1 = 13.3 g B2 = 0.6 g)<br>3. PRECONDITIONING BELT: 50 PRINTS GREEN ONLY<br>4. MEASURE BLACK AND GREEN LATITUDE | BLACK AND GREEN CLEANS<br>170 PRINTS OF BLACK AND GREEN ARE REQUIRED TO CLEAN BOTH BLACK AND GREEN. THIS DROPPED BLACK TONER WEIGHT IN B1 TO THE LEVEL REQUIRED TO CLEAN BLACK ONLY |
| 8 | BLACK ONLY | BASF | 1. NEW BELT<br>2. BRUSHES CLEANED THEN 0.2 GRAMS OF ZNST ADDED TO B1<br>3. PRECONDITIONING BELT NO<br>4. MEASURE BLACK LATITUDE | BLACK CLEANS<br>FULL BLACK ONLY LATITUDE. THIS SHOWS THAT 12.6 GRAMS OF BLACK TONER IS NOT NEEDED WHEN THE FIRST BRUSH IS PRIMED WITH 0.2 GRAMS OF ZNST. |
| 9 | BLACK ONLY | BASF | 1. NEW BELT<br>2. SAME BRUSHES AS IN TEST 8<br>3. PRECONDITIONING BELT NO | BLACK FAILS<br>THIS SHOWS THAT THE ZNST IN THE BRUSHES IN NOT SUFFICIENT TO MAKE BLACK ONLY CLEAN. |

TABLE 3-continued

PRECONDITION TESTS FOR BASF BRUSHES

| TEST | TONER | BRUSH | PROCEDURE | RESULTS |
|---|---|---|---|---|
| | | | 4. MEASURE BLACK LATITUDE | WHAT IS NEED IS THE ZNST ON THE PHOTORECEPTOR. |
| 10 | BLACK ONLY | BASF | 1. NEWBELT<br>2. BRUSHES FROM TEST 9. THEN 0.2 GRAMS OF ZNST ADDED TO B1<br>3. PRECONDITIONING BELT NO<br>4. MEASURE BLACK LATITUDE | BLACK CLEANS<br>FULL BLACK ONLY LATITUDE REPEATED. THIS SHOWS THAT THAT THE ZNST IN THE BRUSH IS DEPOSITED ONTO THE PHOTORECEPTOR, AND THE ZNST ON THE PHOTORECEPTOR REDUCES TONER ADHESION TO THE PHOTORECEPTOR, AND ALLOWS CLEAN TO START IMMEDIATELY |

TABLE 4

PRECONDITION TESTS FOR SA-7 BRUSHES

| TEST | TONER | BRUSH | PROCEDURE | RESULTS |
|---|---|---|---|---|
| 1 | BLACK ONLY | SA-7 | 1. NEW BELT<br>2. BRUSHES CLEAN<br>3. PRECONDITIONING BELT: NO<br>4. MEASURE BLACK LATITUDE | BLACK FAILS INITIALLY, AND THEN STARTS TO CLEAN AFTER ABOUT 30 PRINTS WITH A FULL OPERATING LATITUDE<br>B1 = 1.1 GRAMS, B2 = 0.1 GRAMS<br>THUS FOR CLEANING BLACK ONLY THE SA-7 BRUSHES WILL CLEAN AT THE OUTSET. THE SA-7 BRUSHES NEED ABOUT 1 GRAM OF BLACK TONER IN THEM TO START CLEANING 100% AT THE OUTSET. |
| 2 | GREEN ONLY | SA-7 | 1. NEW BELT<br>2. BRUSHES CLEAN<br>3. PRECONDITIONING BELT: 10 PRINTS OF GREEN<br>4. MEASURE GREEN LATITUDE | GREEN FAILS |
| 3 | GREEN ONLY | SA-7 | 1. SAME BELT AS IN TEST 2 ABOVE<br>2. BRUSHES FROM TEST 2<br>3. PRECONDITIONING BELT: 190 PRINTS OF GREEN: THIS<br>4. MEASURE GREEN LATITUDE | GREEN FAILS WORSE<br>ADDING ONLY GREEN TO THE BRUSH THE FAILURE GETS WORSE THEREFORE, BLACK IS INTRODUCED IN THE NEXT TEST. |
| 4 | GREEN AND BLACK | SA-7 | 1. SAME BELT AS IN TEST 3 ABOVE<br>2. BRUSHES FROM TEST 3 ABOVE<br>3. PRECONDITIONING BELT: 20 PRINTS OF GREEN AND BLACK<br>4. MEASURE GREEN LATITUDE ONLY | GREEN FAILS |
| 5 | GREEN AND BLACK | SA-7 | 1. SAME BELT AS IN TEST 4 ABOVE<br>2. BRUSHES FROM TEST 4 ABOVE<br>3. PRECONDITIONING BELT: 80 PRINTS OF GREEN AND BLACK. THIS CORRESPONDS TO 100 GREEN AND BLACK PRINTS<br>4. MEASURE GREEN LATITUDE ONLY | GREEN FAILS |
| 6 | GREEN AND BLACK | SA-7 | 1. SAME BELT AS IN TEST 5 ABOVE<br>2. BRUSHES FROM TEST 5 ABOVE<br>3. PRECONDITIONING BELT 100 PRINTS OF GREEN AND BLACK: THIS CORRESPONDS TO TO 200 GREEN PRINTS<br>4. MEASURE GREEN LATITUDE ONLY | GREEN FAILS<br>AFTER ALL THIS GREEN STILL FAILS; THE BRUSH WEIGHTS AFTER 200 GREEN AND BLACK PRINTS ARE B1 = 0.6 GRAMS B2 = 0.3 GRAMS |
| 7 | GREEN AND BLACK | SA-7 | 1. SAME BELT AS IN TEST 6 ABOVE<br>2. BRUSHES FROM TEST 5 ABOVE<br>3. PRECONDITIONING BELT: 100 PRINTS OF GREEN AND BLACK. THIS CORRESPONDS TO 200 GREEN AND BLACK PRINTS<br>4. MEASURE GREEN LATITUDE ONLY | GREEN FAILS<br>AFTER ALL THIS GREEN STILL FAILS: THE BRUSH WEIGHTS AFTER 200 GREEN AND BLACK PRINTS ARE B1 = 0.6 GRAMS B2 = 0.3 GRAMS IN THE NEXT TEST WE WILL INTRODUCE BLACK ONLY TO SEE HOW MUCH BLACK IS REQUIRED IN B1 SO THAT GREEN CAN BE CLEANED |
| 8 | BLACK | SA-7 | 1. SAME BELT AS IN TEST 7 ABOVE<br>2. BRUSHES FROM TEST 5 ABOVE<br>3. PRECONDITIONING BELT: NO<br>4. MEASURE GREEN LATITUDE ONLY<br>5. OBJECT IS TO ADD BLACK ONLY IN 200 PRINT INCREMENTS AND MEASURE GREEN LATITUDE | GREEN CLEANS<br>AFTER 800 PRINTS IT WAS FOUND THAT B1 = 6.6 GRAMS AND B2 = 0.0. THUS IT TOOK 800 PRINTS OF BLACK ONLY TO INCREASE THE BLACK TONER WEIGHT IN B1 TO A LEVEL (6.6 GRAMS) TO START GREEN CLEAN, AND OBTAIN THE SAME OPERATING LATITUDE FOUND EARLIER IN LATITUDE TESTS |

TABLE 5

| ROS Print Selection | Toner Density 0.9 mg/cm$^2$ | 1 mg/cm$^2$ |
|---|---|---|
| 20 prints | 5.52 | 6.14 |
| 30 prints | 8.3 | 9.21 |
| 40 prints | 11.0 | 12.3 |
| 60 prints | 16.6 | 18.6 |
| 200 prints | 55.2 | 62 |

It is claimed:

1. A method for loading particles on a brush adapted to contact an imaging surface used in a printing machine of the type having successive images developed thereon, comprising the steps of:

initializing a conductive cleaning brush once for the life of the brush in the printing machine;

forming an image developed with particles on the imaging surface;

removing the particles from the imaging surface with the brush such that the particles adhere to the brush;

stopping initialization of the brush; and actuating the printing machine to start the printing process.

2. The method of claim 1, wherein said forming step includes:

recording a latent image on the imaging surface having a line pattern; and developing the recorded latent image on the imaging surface.

3. The method of claim 2, wherein the imaging surface of the recording step has an imaging region and a non-imaging region thereon.

4. The method of claim 3, wherein said step of developing comprises developing the latent image with said particles in said imaging region.

5. The method of claim 4, wherein said step of developing the latent image with said particles comprises a predetermined amount of said particles being recorded in said imaging region for adherence to the brush.

6. The method of claim 5, wherein said particles of said developing step comprises black toner particles.

7. The method of claim 6, wherein said step of removing said particles from the imaging surface with the brush comprises the brush electrostatically holding said particles removed from said imaging region.

8. The method of claim 7, wherein said step of stopping initialization of the brush occurs when said predetermined amount of said particles on said imaging region are removed therefrom and adhered to the brush creating an initialized brush.

9. The method of claim 1, further comprising:

cleaning residual particles from the imaging surface remaining after transferring a developed image from the imaging region during the printing process;

cleaning said residual particles from the imaging surface with said initialized brush; and detoning said initialized brush.

10. An apparatus for loading particles on a brush adapted to contact an imaging surface used in a printing machine of the type having successive images developed thereon, comprising:

means for initializing a conductive cleaning brush once for the life of the cleaning brush in the printing machine;

means for forming an image developed with particles on the imaging surface;

means for removing the particles from the imaging surface with the brush such that the particles adhere to the brush;

means for stopping initialization of the brush; and means for actuating the printing machine to start the printing process.

11. The apparatus as recited in claim 10, wherein said forming means includes a latent image recorded on the imaging surface having a line pattern.

12. The apparatus as recited in claim 11, wherein the imaging surface of said means for recording has an imaging region and a non-imaging region thereon.

13. The apparatus as recited in claim 12, wherein said means for developing comprises means for developing the latent image with said particles in said imaging region.

14. The apparatus as recited in claim 13, wherein said means for developing the latent image with said particles comprises a predetermined amount of said particles being deposited in said imaging region for adherence to the brush.

15. The apparatus as recited in claim 14, wherein said particles of said means for developing comprises black toner particles.

16. The apparatus as recited in claim 15, wherein said means for removing said black toner particles from the imaging surface with the brush comprises said brush electrostatically holding said black toner particles removed from said imaging region.

17. The apparatus as recited in claim 16, wherein said means for stopping initialization of the brush occurs when said predetermined amount of said black toner particles on said imaging region are removed therefrom and adhered to said brush creating an initialized brush.

18. The apparatus as recited in claim 17, further comprising:

means for cleaning residual particles from the imaging surface remaining after transferring a developed image from the imaging region;

means for cleaning said residual particles from the imaging surface with said initialized brush; and means for detoning said initialized brush during the printing process.

19. The apparatus as recited in claim 10, wherein the particles are non-black toner particles.

* * * * *